US006442761B1

(12) United States Patent
Huang

(10) Patent No.: US 6,442,761 B1
(45) Date of Patent: Sep. 3, 2002

(54) DISPOSABLE GLOVE

(76) Inventor: Hsun Hui Lin Huang, P.O. Box 90, Tainan City (TW)

( * ) Notice: Subject to any disclaimer, the term of this patent is extended or adjusted under 35 U.S.C. 154(b) by 0 days.

(21) Appl. No.: 09/961,087

(22) Filed: Sep. 24, 2001

(51) Int. Cl.[7] ..... A41D 19/00
(52) U.S. Cl. ..... 2/161.7; 2/162
(58) Field of Search ..... 2/159, 161.6, 161.7, 2/161.8, 162, 168; 15/227

(56) References Cited

U.S. PATENT DOCUMENTS 4,476,588 A * 10/1984 Long ..... 2/169
4,845,780 A * 7/1989 Reimers et al. ..... 2/160
4,884,300 A * 12/1989 Vistins ..... 2/162
5,020,159 A * 6/1991 Hellickson ..... 2/158
5,187,813 A * 2/1993 Klein ..... 2/16
5,867,832 A * 2/1999 Liu ..... 2/161.7
6,119,272 A * 9/2000 Tebbe ..... 2/161.7

* cited by examiner

*Primary Examiner*—Peter Nerbun
*Assistant Examiner*—Katherine Moran

(57) ABSTRACT

A disposable glove includes a glove body, a cuff formed in a lower end of the glove, and an adhesive tape laterally adhered on an outer surface of the glove. The adhesive tape consists of a long adhesive tape, a short adhesive tape, a connect tape and a pull member combined together. After a user wears the glove on a hand and a wrist, the user pulls the pull member adhered on an inner end of the long adhesive tape and together with an inner half of the long adhesive tape and pulls it to the left side to tighten cuff and then adhere the inner half of the long adhesive tape on the outer surface of the glove to keep the cuff in a tightened condition.

1 Claim, 4 Drawing Sheets

DISPOSABLE GLOVE

BACKGROUND OF THE INVENTION

1. Field of the Invention

This invention relates to a disposable glove, particularly to one having a cuff able to be tightened firmly on a wrist of a user and not sliding down on the wrist so that no dirty matters may splash and/or flow into inside of the glove, which is very safe and hygienic to use.

2. Description of the Prior Art

A known conventional disposable glove shown in FIG. 1 has a glove body 1 and a cuff 10 having a larger diameter than that of a wrist of a user so as to permit a hand of the user to be inserted through the cuff to wear the glove 1. In wearing the glove 1, the portion covering on the wrist of a user may often slide down due to looseness of the cuff 10. Therefore, the glove has to be often pulled up tightly, causing disturbance to the work being done and worsening quality of the work. In addition, if the cuff 10 slides down, dirty matters such as blood, oil, chemical solutions, food, dirty water, etc may splash on the wrist or flow through the cuff 10 into the glove 1. Then the glove largely loses its function. Someone may use a rubber band constricting the cuff 10 for preventing such flowing of dirty matters into the glove through the cuff 10, but the rubber band may be too tight to let blood circulate; not an ideal situation.

SUMMARY OF THE INVENTION

The objective of the invention is to offer a disposable glove having its cuff conveniently bound tightly on a wrist of a user, not letting the cuff slide down.

The feature of the invention is an adhesive provided on an outer surface of the glove near the cuff and consisting of a long adhesive tape, a short adhesive tape, a connecting tape and a pull member combined together. The long adhesive tape and the short adhesive tape have respectively an adhesive inner surface and an outer non-adhesive surface, connected with the connect member at the middle section of the long adhesive tape, with the pull member connected with an outer end of the long adhesive tape.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
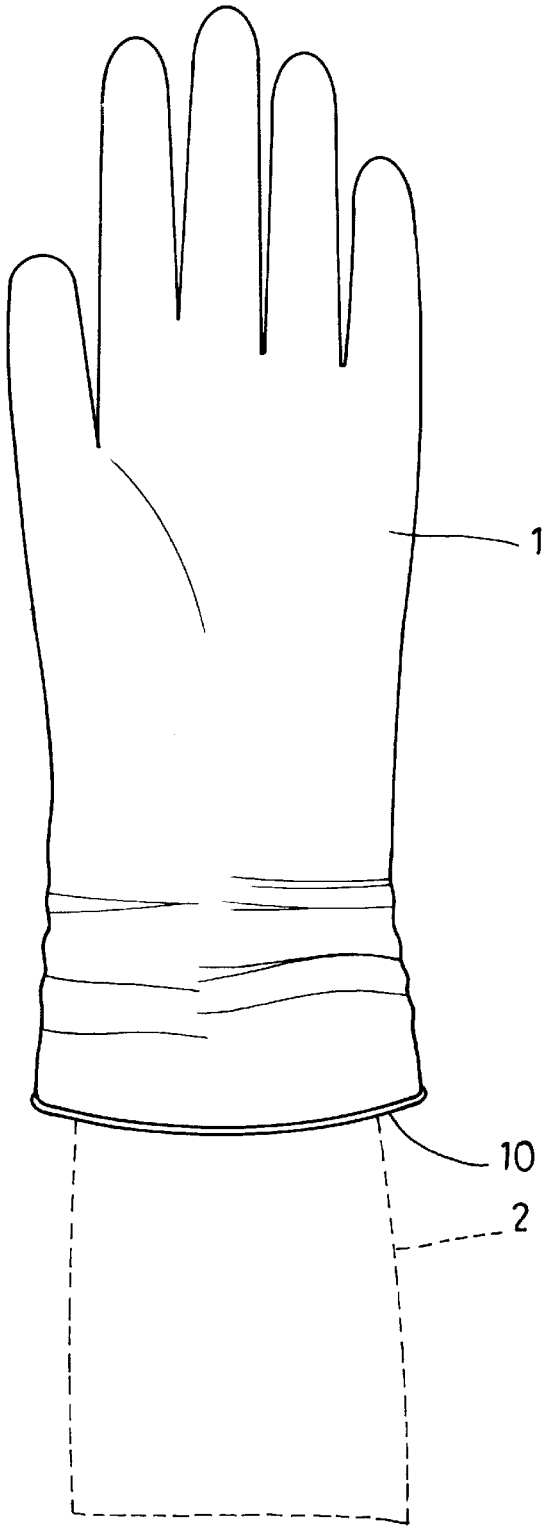
FIG.1 (PRIOR ART)
FIG. 1 is a perspective view of a known conventional disposable glove.
Figure 2:
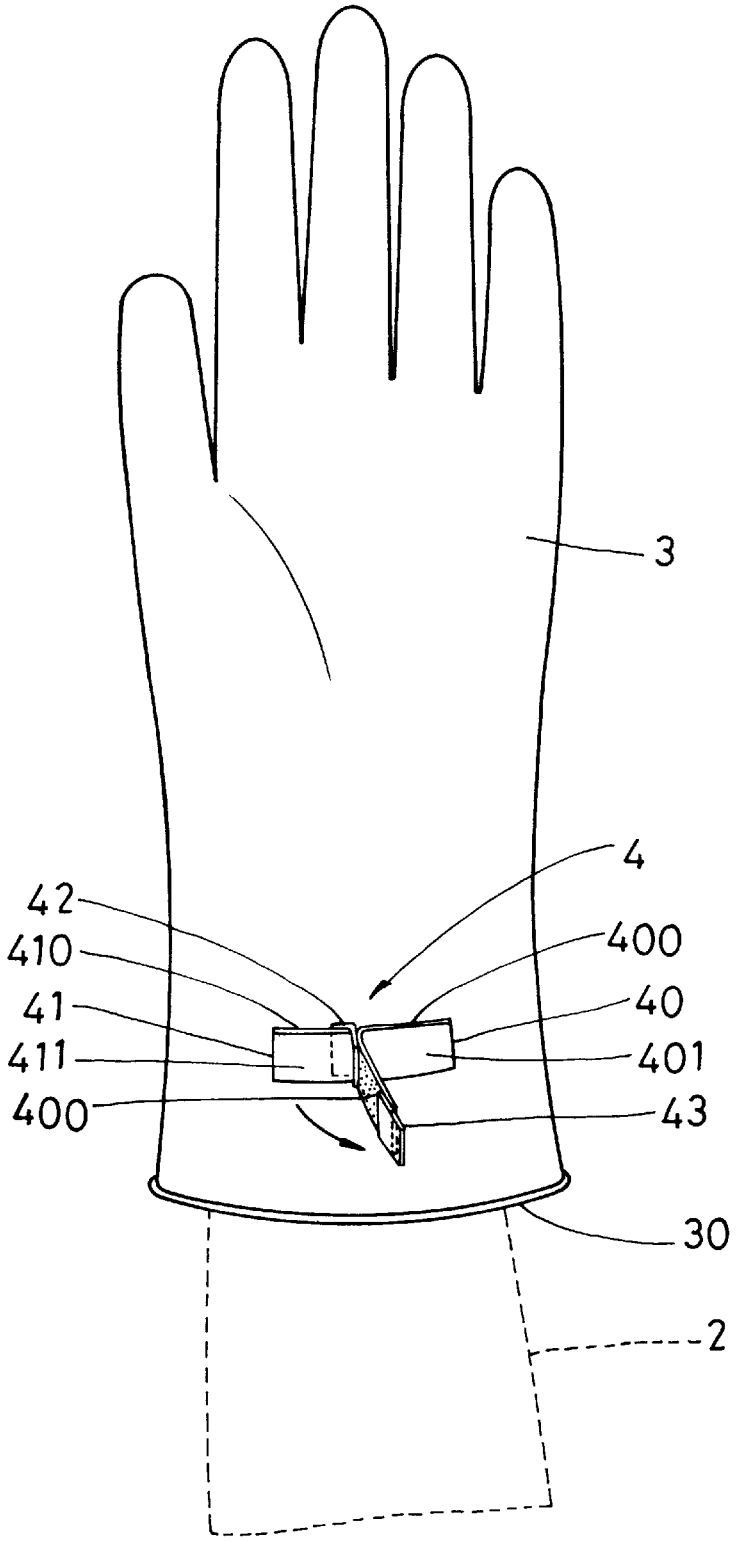
FIG. 2 is a perspective view of a disposable glove in the present invention.
Figure 3:
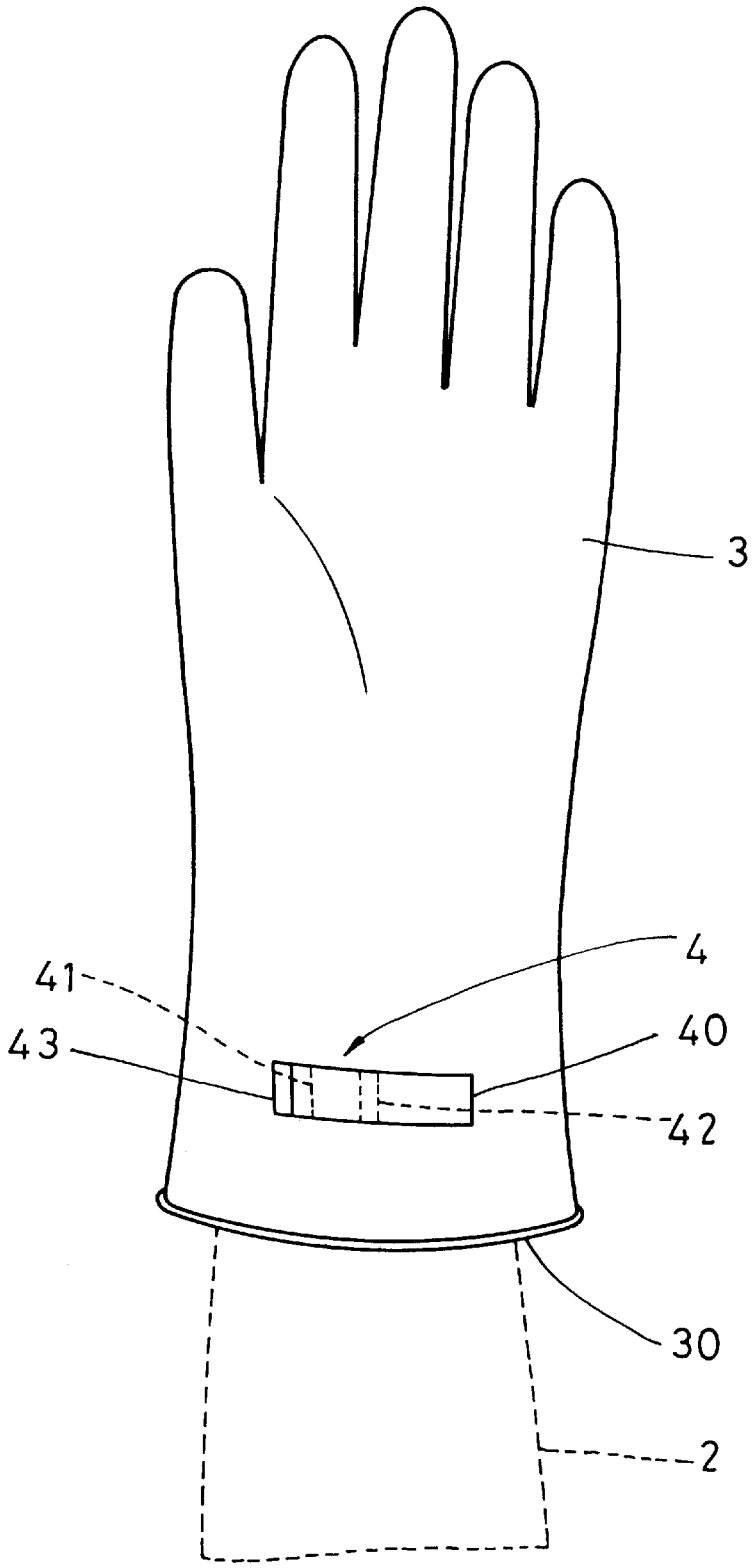
FIG. 3 is a perspective view of the disposable glove in the present invention, showing the adhesive tape being used; and, FIG. 4 is a perspective view of the disposable glove in the present invention, showing the adhesive tape adhered tightly on a cuff of the glove located on a wrist of a user.

A preferred embodiment of a disposable glove in the present invention, as shown in FIGS. 2 and 3, includes a glove body 3, a cuff 30 formed in a lower end of the glove 3, and an adhesive tape 4 laterally adhered near the cuff 30.

The adhesive tape 4 is the main improvement in the invention, consisting of a long adhesive tape 40, a short adhesive tape 41, a connector tape 42 and a pull member 43 combined together. Inner surfaces 400 and 410 of the long and the short adhesive tape 40 and 41 are coated with an adhesive layer and outer surfaces 401 and 411 of the long and short adhesive tape 40 and 41 are not coated with an adhesive layer. The inner end of the short adhesive tape 41 is connected with the middle section of the long adhesive tape 40 with the connect tape 42, with the pull member 43 being adhered with an outer inner surface of the long adhesive tape 41, with the outer half adhesive surface 400 of the long adhesive tape adhered on the non-adhesive surface 411 of the short adhesive tape 41, which has its inner adhesive surface 410 adhered on the outer surface of the glove 3. Then the pull member 43 may easily pull the outer half of the long adhesive tape 40 off the non-adhesive surface 411 of the short adhesive tape 41. Then the inner adhesive surface 411 of the short adhesive tape 41 and the outer half inner adhesive surface 400 of the long adhesive tape 40 are adhered firmly and flatly on the outer surface of the glove 3 near the cuff 30 laterally.

Figure 4:
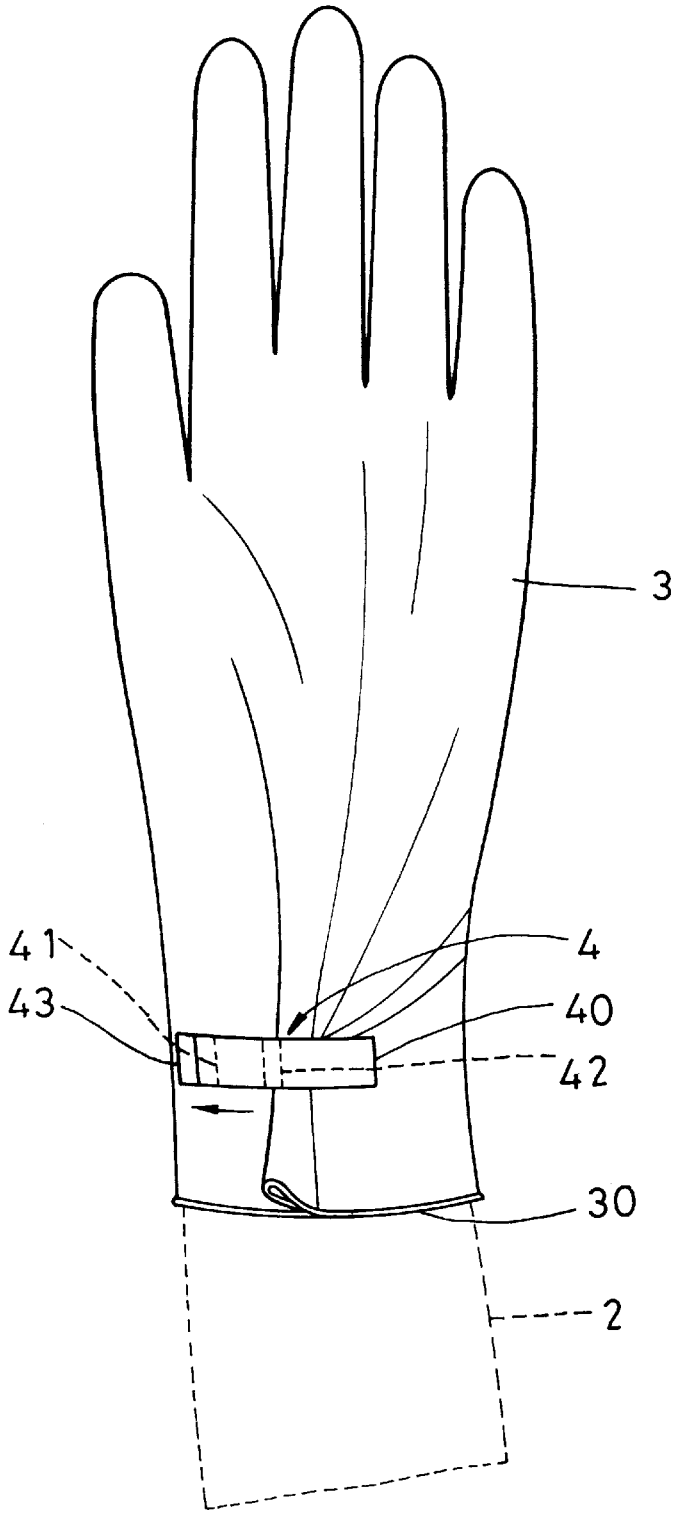

In using the disposable glove in the invention, referring to FIGS. 2, 3 and 4, a user wears the glove 3 on a hand and a wrist 2, with the cuff 30 still being in a very loose condition. Then the user pulls up the pull member 43 together with the outer half of the long adhesive tape 40 off the non-adhesive surface 411 of the short adhesive tape 41 with two fingers, and pulls the outer half of the long adhesive tape 40 to the left side until the cuff 30 of the glove becomes tight. Under that condition, the user presses down the outer half of the long adhesive tape 40 on the cuff 30 covering the wrist of the user to let the inner adhesive surface 400 of half the long adhesive tape adhere firmly on the outer surface of the glove 3 near the cuff 30, letting the cuff 30 tightly surrounding the wrist of the user, without possibility of the cuff 30 sliding down the wrist. Then dirty matters (such as blood, oil, chemical solution, food, dirty water, etc.) may not flow through the cuff 30 into the glove 3, very safe and hygienic to use, as shown in FIG. 4. Further, the cuff 30 is tightened on the wrist of the user, with no fear of sliding down, ensuring prevention of exterior dirty matters from flowing through the cuff 30 into the glove 3.

While the preferred embodiment of the invention has been described above, it will be recognized and understood that various modifications may be made therein and the appended claims are intended to cover all such modifications that may fall within the spirit and the scope of the invention.

What is claimed is:

1. A disposable glove comprising a glove body, a cuff formed in a lower end of said glove body, and an adhesive tape laterally adhered firmly on an outer surface of said glove body near said cuff, said adhesive tape consisting of a short adhesive tape, a long adhesive tape, a connect tape and a pull member, said long and said short adhesive tape both having an inner adhesive surface and an outer non-adhesive surface, said connect tape connecting an inner end of said short adhesive tape with a middle section of said long adhesive tape, an outer half adhesive surface of said long adhesive tape adhered on the non-adhesive surface of said short adhesive tape and an inner half adhesive surface adhered on an outer surface of said glove normally, and said pull member adhered on an inner end of said long adhesive tape.

* * * * *